United States Patent [19]

Montandon

[11] Patent Number: 4,637,334

[45] Date of Patent: Jan. 20, 1987

[54] ROLLER FURLING ELEMENT FOR BOATS EQUIPPED WITH SAILS

[75] Inventor: Daniel Montandon, Yverdon-Les-Bains, Switzerland

[73] Assignee: Nirvana Espar Systems, S.A., Yverdon-Les-Bains, Switzerland

[21] Appl. No.: 755,751

[22] Filed: Jul. 17, 1985

[30] Foreign Application Priority Data

Jul. 27, 1984 [CH] Switzerland ..... 03638/84

[51] Int. Cl.[4] ..... B63H 9/10

[52] U.S. Cl. ..... 114/106; 114/105; 114/90

[58] Field of Search ..... 114/104, 105, 106, 107, 114/90, 91

[56] References Cited

U.S. PATENT DOCUMENTS 2,454,640 11/1948 Eichner ..... 114/90
3,851,609 12/1974 Stearn ..... 114/105
4,090,461 5/1978 Rusich ..... 114/107

FOREIGN PATENT DOCUMENTS 2395883 3/1979 France ..... 114/90

*Primary Examiner*—Sherman D. Basinger
*Assistant Examiner*—Paul E. Salmon
*Attorney, Agent, or Firm*—Pollock, Vande Sande & Priddy

[57] ABSTRACT

The roller furling element of this invention is formed by a single piece profiled member extruded from aluminum and includes:

two concentric cylindrical tubes, the internal one being adapted to accommodate a stay, and the external one having two longitudinal slots each allowing a sail to pass through, the bolt rope of which may be held between the two tubes; and longitudinal walls distributed within the annular space between the tubes and uniting the tubes to one another.

6 Claims, 2 Drawing Figures

ROLLER FURLING ELEMENT FOR BOATS EQUIPPED WITH SAILS

This invention concerns arrangements employed on sailing boats for roller furling a head sail such as a jib or a genoa. In particular it concerns the roller arrangement itself, that it to say, the element around which the sail is rolled.

BACKGROUND OF THE INVENTION

Roller furling arrangements for sails give the possibility of adapting the useful surface to the force of the wind, permitting navigation under the best conditions of efficiency and of security.

The roller element is a tubular member through which runs the stay which, while supporting the sail, connects the top of the mast to the bow of the boat.

This tubular member provides a longitudinal slot intended to receive and retain the edge of the sail generally provided with a reinforcing member referred to as the bolt rope. Most often, in order to permit the simultaneous furling of two sails, the roller element comprises two parallel slots. At the same time two such slots facilitate sail changes while the boat is underway. Finally, the lower end of the furling element is connected to a drive mechanism enabling rotation of the element around the stay in order to roller furl the sail.

Roller furling arrangements available at the present time are generally formed from a series of hollow elements which are fixed end to end by a system of notches enabling the transmission of a rotational couple.

This conception of a sail furling arrangement gives the disadvantage of being not very reliable since there are important torsion stresses appearing at the place of connection between two consecutive elements during furling, bringing about rapid wear of the arrangement. On the other hand, under the pressure of the wind, the roller element does not present a resistance to bending which is entirely satisfactory whereby the sail, on being rolled up may form folds and lumps and so bring about its rapid deterioration. Finally, in order to assure a system having sufficient strength, the element of the roller element must have relatively thick walls and thereby considerable weight, this constituting an obvious disadvantage.

The present invention has as its purpose to provide a roller furling element for a sail which avoids the disadvantages of the known systems, thus, it is light and at the same time resistant as much to torsion as to bending.

SUMMARY OF THE INVENTION

In order to attain this objective, the roller furling element according to the invention is formed by a single piece profiled member extruded from a light metal or alloy and including two concentric cylindrical tubes, the internal one being adapted to accommodate a stay and the external one having a longitudinal slot allowing passage of a sail therethrough, the bolt rope of which may be held between the two tubes, and longitudinal walls distributed within the annular space between the tubes and uniting the tubes to one another.

Further characteristics of the invention as well as its advantages will appear from the description to follow having regard to the attached drawings and showing by way of explanation but not by way of limitation an advantageous form of such a roller furling arrangement.

DESCRIPTION OF THE PREFERRED EMBODIMENT

Figure 1:
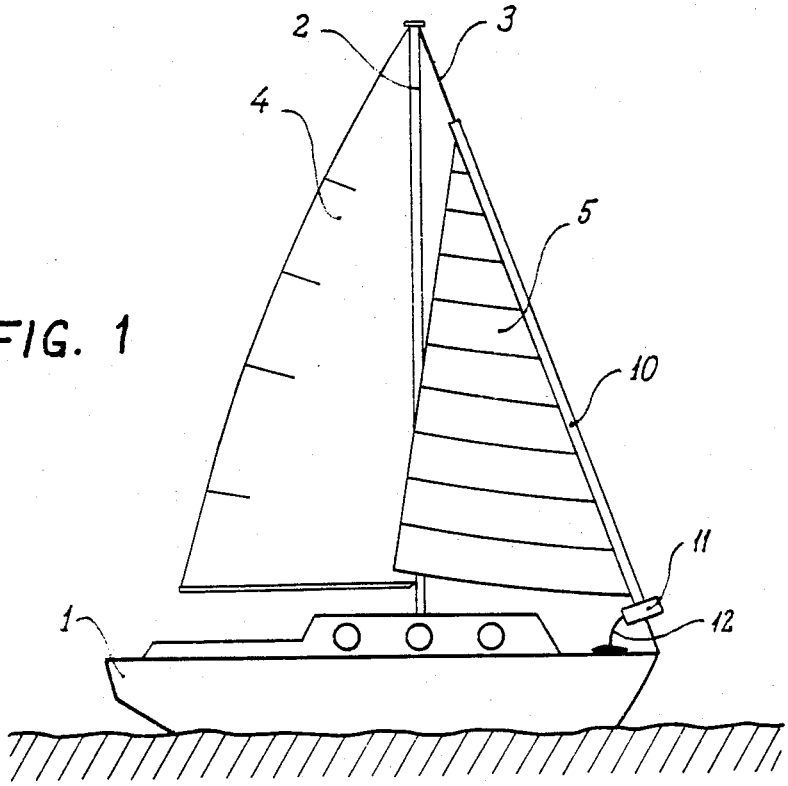
FIG. 1 shows a sailing boat provided with a roller furling arrangement for a sail.

FIG. 1 shows schematically a sailing boat which comprises essentially a hull 1, a mast 2 vertically fixed approximately at the center of the hull and a stay 3, generally in the form of a steel cable coupling the top of the mast to the bow of the boat. The sail arrangement, for its part, is comprised of a main sail 4 attached by one edge (the luff) to mast 2 and at the bow of the boat a head sail 5 referred to as a genoa or jib. The latter is attached by an edge (luff) to a roller 10 mounted on the stay 3 about which it is free to rotate.

At its lower extremity, that is to say, that which is proximate the hull 1 of the boat, the roller element 10 is connected to driving means enabling the rotation thereof about the stay. Such means, known in the prior art, includes for instance a pulley 11 mounted on the roller element 10 and on which is wound a rope 12. Pulling on the rope causes it to unwind and thus rotate the pulley and furl the sail 5 about the roller 10. As soon as the furling is finished the arrangement may be blocked by locking means such as a jam cleat (not shown). The driving means may, as is well understood, include an electric motor in order to avoid any manual operation.

Figure 2:
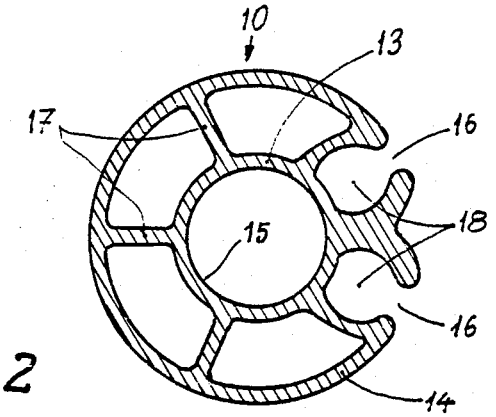
FIG. 2 is a radial cross section view of a roller element for two sails according to the invention.

Reference will now be made to FIG. 2 which shows a radial cross section of an advantageous structure of a roller element 10 according to the invention, enabling the simultaneous roller furling of two sails. This roller element is formed by a single piece profiled member extruded from a light metal or alloy such as aluminum and mainly comprises two concentric cylindrical tubes, an internal tube 13, and an external tube 14. The internal tube 13 bounds a circular conduit 15 for the passage of the stay 3. Plastic rings (not shown) distributed along the length of the tube avoid direct contact between the cable forming the stay and the roller element and facilitate the rotation of this latter.

As already mentioned, the roller element described is intended to receive two sails. It is for this reason that the outer tube 14 provides two longitudinal parallel slots 16 close to one another. These slots have a width just sufficient to permit entry of the sail but insufficient to permit passage of the bolt rope.

Longitudinal walls 17, seven in number in the example shown, are distributed more or less regularly in the annular space separating the two tubes and assure their union with one another. Three of these walls (in the left half of the drawing) are planar and oriented radially to the tube 14. The four remaining walls the extremities of which arrive at the edges of slots 16 have concave profiles in a manner to form two lodgings 18 each with a roughly circular cross section intended to receive and retain a bolt rope.

The roller element according to the invention may be obtained in several diameters according to the dimensions of the boat. Typically, for a roller having a length of 17 meters, the two tubes have respective diameters of 5.5 cm and 2.7 cm and a thickness of 2 mm. The longitudinal walls connecting the tubes to one another have a thickness of 2 mm.

The advantages of this invention are clearly apparent from the preceding description. Thus the cellular construction of the roller element on one hand and the fact that it is realized in a single piece on the other confer to it important advantages in particular extra lightness and excellent resistance to bending as well as torsion. Moreover, being given that the roller element is obtained by extrusion in a single operation its manufacturing cost is considerably reduced.

It is well understood that the invention is not limited to a single realization and that the scope of this patent may extend to variants of the arrangements described which may be considered equivalent.

What I claim is:

1. A roller furling element for boats equipped with sails comprising a single piece profiled member extruded from a light metal or alloy and including:

two concentric cylindrical tubes defined by peripheral walls of substantially uniform thickness and having substantially the same uniform wall thickness, the peripheral wall of the internal tube being continuous and alone defining a cylindrical chamber adapted to accommodate a stay for rotation of said profiled member around said stay, and the peripheral wall of the external tube having a longitudinal slot allowing passage of a sail therethrough, the bolt rope of which may be held between the two tubes; and, longitudinal walls distributed within the annular space between the tubes and uniting the tubes to one another, said longitudinal walls being integrally connected to said peripheral walls by said extrusion to provide a single extruded piece having a cellular construction for resisting bending as well as torsion, a plurality of said longitudinal walls having substantially the same thickness as said tubes, and two of said longitudinal walls being proximate the edges of said slot and having concave profiles so as to form a lodging of roughly circular cross-section for receiving and retaining the bolt rope of the sail.

2. A roller furling element as set forth in claim 1 wherein the external tube is provided with two identical parallel longitudinal slots enabling the attaching of two sails.

3. A roller furling element as set forth in claim 1 wherein said metal is aluminum.

4. A roller furling element as set forth in claim 1 wherein the number and distribution of said longitudinal walls within said annular space between the tubes are such that said single piece profiled member is resistant substantially as much to torsion as to bending.

5. A roller furling element as set forth in claim 1 wherein said cellular construction includes closed cells extending around a majority of the circumference of said internal cylindrical tube.

6. A roller furling element as set forth in claim 5 wherein said cellular construction includes four closed cells.

* * * * *